US009841021B2

(12) United States Patent
Kim et al.

(10) Patent No.: US 9,841,021 B2
(45) Date of Patent: Dec. 12, 2017

(54) NO CORNER SEAL ROTARY VANE ACTUATOR

(71) Applicant: Woodward, Inc., Fort Collins, CO (US)

(72) Inventors: Joseph H. Kim, Valencia, CA (US); Robert P. O'Hara, Castaic, CA (US); Shahbaz H. Hydari, Los Angeles, CA (US)

(73) Assignee: Woodward, Inc., Fort Collins, CO (US)

( * ) Notice: Subject to any disclaimer, the term of this patent is extended or adjusted under 35 U.S.C. 154(b) by 508 days.

(21) Appl. No.: 13/830,885

(22) Filed: Mar. 14, 2013

(65) Prior Publication Data

US 2014/0271296 A1 Sep. 18, 2014

(51) Int. Cl.
*F04C 15/00* (2006.01)
*F03C 2/30* (2006.01)

(52) U.S. Cl.
CPC ..... *F04C 15/0007* (2013.01); *F03C 2/304* (2013.01)

(58) Field of Classification Search
CPC ..... F01C 9/002
USPC ..... 92/125
See application file for complete search history.

(56) References Cited

U.S. PATENT DOCUMENTS 860,461 A 7/1907 Germiner
1,116,974 A 11/1914 Bergesen
2,362,703 A 11/1944 Kuttner
2,778,338 A * 1/1957 Shafer ..... F15B 15/12 92/122
2,951,470 A * 9/1960 Self ..... F15B 15/12 92/125
2,966,144 A * 12/1960 Self ..... F15B 15/12 160/188
2,984,221 A 5/1961 Voorhees
3,053,236 A 9/1962 Self et al.
3,207,048 A * 9/1965 Rumsey ..... B60P 1/5433 277/345
3,419,114 A 12/1968 Rumsey
(Continued)

FOREIGN PATENT DOCUMENTS

CN 2429672 Y 5/2001
CN 1693720 A 11/2005
(Continued)

OTHER PUBLICATIONS

"Hydraulic rotary vane actuators", Micromatic LLC [online] [retrieved on Mar. 29, 2012] Retrieved from the Internet: <URL: http://www.micromaticllc.com/actuator-applications.aspx/hydraulic-rotary-vane-actuators, 1 page.
(Continued)

*Primary Examiner* — Thomas E Lazo
*Assistant Examiner* — Matthew Wiblin
(74) *Attorney, Agent, or Firm* — Fish & Richardson P.C.

(57) ABSTRACT

The subject matter of this specification can be embodied in, among other things, a rotary vane actuator. A rotor assembly includes longitudinal vanes disposed radially on a central shaft, with each vane connected at their ends to a circular plates secured to the shaft. Each vane has an outer edge, wherein the shaft, a surface of each plate, and the vanes define interior pockets in the rotor assembly. A stator assembly includes two stator elements each having a first longitudinal edge and a second longitudinal edge.

5 Claims, 6 Drawing Sheets

(56) References Cited

U.S. PATENT DOCUMENTS

| | | | | |
|---|---|---|---|---|
| 3,444,788 | A | 5/1969 | Sneen | |
| 3,446,120 | A | 5/1969 | Sneen | |
| 3,554,096 | A | 1/1971 | Dejager | |
| 3,659,503 | A | 5/1972 | Ehluss et al. | |
| 3,688,645 | A | 9/1972 | Reaves | |
| 4,009,644 | A | 3/1977 | Higuchi et al. | |
| 4,027,576 | A * | 6/1977 | Nomura | F16J 15/545 417/481 |
| 4,471,967 | A * | 9/1984 | Meyer | F04C 15/003 277/345 |
| 4,565,119 | A * | 1/1986 | Higuchi | F01C 19/08 277/345 |
| 4,601,231 | A * | 7/1986 | Shimoda | F15B 15/12 91/26 |
| 4,628,797 | A | 12/1986 | Kendall | |
| 4,823,678 | A * | 4/1989 | Sollami | F15B 15/12 92/121 |
| 5,044,257 | A | 9/1991 | Scobie | |
| 5,054,374 | A | 10/1991 | Scobie et al. | |
| 5,235,900 | A | 8/1993 | Garceau | |
| 5,386,761 | A | 2/1995 | Holtgraver | |
| 5,495,791 | A | 3/1996 | Sande et al. | |
| 5,722,616 | A | 3/1998 | Durand | |
| 6,520,068 | B1 | 2/2003 | Collier et al. | |
| 7,441,493 | B2 | 10/2008 | Beetz et al. | |
| 7,895,935 | B2 | 3/2011 | Kells | |
| 8,074,999 | B2 | 12/2011 | Burdick et al. | |
| 2010/0283275 | A1 | 11/2010 | Amelsfoort | |
| 2013/0309115 | A1 | 11/2013 | Thorwart et al. | |

FOREIGN PATENT DOCUMENTS

| | | |
|---|---|---|
| DE | 1258275 | 1/1968 |
| DE | 2309959 | 8/1974 |
| GB | 1015462 | 12/1965 |
| JP | S50-22666 | 8/1975 |
| JP | S55078806 | 6/1980 |
| WO | WO2014105337 A1 | 7/2014 |

OTHER PUBLICATIONS

"Rotary Vane Actuators", Turn-Act, 24 pages.

"Rotary Vane Actuator," Emerson Process Management [online] [retrieved on Mar. 29, 2012] Retrieved from the Internet: <URL: http://www2.emersonprocess.com/en-US/brands/shafer/valve_actuators/RV-Series/Pages/ . . . , 1 page.

Rotary-Actuator Image [online] [retrieved on Mar. 29, 2012] Retrieved from the Internet: <URL: http://images.grainger.com/B356_25/images/products/250x250/Rotary-Actuator-5PEY4 . . . , 1 page.

"Rotary Cylinders/Rotary Vane Actuators," Douce-Hydro, published on or before Oct. 2008, 2 pages.

* cited by examiner

NO CORNER SEAL ROTARY VANE ACTUATOR

TECHNICAL FIELD

This invention relates to an actuator device and more particularly to a rotary vane type actuator device wherein the vanes of the rotor are moved by fluid under pressure.

BACKGROUND

Rotary hydraulic actuators of various forms are currently used in industrial mechanical power conversion applications. This industrial usage is commonly for applications where continuous inertial loading is desired without the need for load holding for long durations, e.g. hours, without the use of an external fluid power supply. Aircraft flight control applications generally implement loaded positional holding, for example, in a failure mitigation mode, using substantially only the blocked fluid column to hold position.

In certain applications, such as primary flight controls used for aircraft operation, positional accuracy in load holding by rotary actuators is desired. Positional accuracy can be improved by minimizing internal leakage characteristics inherent to the design of rotary actuators. However, it can be difficult to provide leak-free performance in typical rotary hydraulic actuators, e.g., rotary "vane" or rotary "piston" type configurations.

SUMMARY

In general, this document relates to rotary vane actuators.

In a first aspect, a rotary vane actuator includes a stator housing having a bore disposed axially therethrough. A rotor assembly includes a central longitudinal shaft, and at least a first longitudinal vane disposed radially on and rigidly connected to the central longitudinal shaft, and at least a second longitudinal vane disposed radially on and rigidly connected to the central longitudinal shaft, said second vane disposed substantially opposite from the first vane, each of said longitudinal vanes connected at a first terminal end to a first circular plate rigidly secured to the output shaft and at a second terminal end to a second circular plate rigidly secured to the output shaft, each of said vanes having an outer longitudinal edge, said longitudinal edge parallel to a central axis of the longitudinal shaft; said longitudinal edge spaced a distance from the central axis substantially equal to an outer radial distance of a circumferential edge of each of the first and second circular plates, wherein a first cylindrical surface of the central longitudinal shaft, a first inner surface of the first plate and a first inner surface of the second plate and a first face of the first longitudinal vane and a first face of the second longitudinal vane define a first interior pocket in the rotor assembly, and wherein a second cylindrical surface of the central longitudinal shaft, a second inner surface of the first plate and a second inner surface of the second plate and a second face of first longitudinal vane and a second face of the second longitudinal vane define a second interior pocket in the rotor assembly. The actuator also includes a stator assembly including a first stator element having a concave interior surface adapted to contact the first cylindrical surface in the first pocket and a convex outer surface adapted to be secured to the bore of the stator housing and sized to be received in the first pocket, said stator element having a first longitudinal edge and a second longitudinal edge, and a second stator element having a concave interior surface adapted to contact the second cylindrical surface in the second pocket and a convex outer surface adapted to be secured to the bore of the stator housing and sized to be received in the second pocket, said stator element having a first longitudinal edge and a second longitudinal edge.

Various embodiments can include some, all, or none of the following features. The first longitudinal edge of the first stator element can be adapted to contact the first face of the first longitudinal vane when the rotor assembly is rotated in a first direction and a second longitudinal edge of the first stator element is adapted to contact the first face of the second longitudinal vane when the rotor assembly is rotated in a second direction opposite to the first direction, and a first longitudinal edge of the second stator element is adapted to contact the second face of the first longitudinal vane when the rotor assembly is rotated in the second direction and a second longitudinal edge of the second stator element is adapted to contact the second face of the second longitudinal vane when the rotor assembly is rotated in the first direction. The rotary actuator can also include at least a first continuous seal groove disposed in the outer longitudinal edge of the first vane and the outer longitudinal edge of the second vane and the circumferential edge of the first plate and the circumferential edge of the second plate, and a continuous seal disposed in the continuous seal groove.

The rotary actuator can also include a first continuous seal groove disposed in the outer longitudinal edge of the first vane and the outer longitudinal edge of the second vane and a first portion of the circumferential edge of the first plate and a first portion of the circumferential edge of the second plate, a second continuous seal groove disposed in the outer longitudinal edge of the first vane and the outer longitudinal edge of the second vane and a second portion of the circumferential edge of the first plate and a second portion of the circumferential edge of the second plate, a first continuous seal disposed in the first continuous seal groove, and a second continuous seal disposed in the second continuous seal groove. The rotary actuator can also include a continuous seal groove disposed in the concave inner surface of the first stator element, the convex outer surface of the first stator element, a first transverse end and a second transverse end of the first stator element and a first continuous stator seal disposed in the continuous seal groove; and a continuous seal groove disposed in the concave inner surface of the second stator element, the convex outer surface of the second stator element and a first and second transverse end of the second stator element and a second continuous stator seal disposed in the continuous seal groove. The first longitudinal vane, the second longitudinal vane and the first plate and the second plate can be formed integrally with central longitudinal shaft. The first longitudinal vane, the first stator and a portion of the first continuous stator seal and a portion of the rotor seal can define a first pressure chamber inside the bore of the stator housing, the second longitudinal vane, the first stator and a portion of the first continuous stator seal and a portion of the rotor seal can define a second pressure chamber inside the bore of the stator housing, the second longitudinal vane, the second stator and a portion of the second continuous stator seal and the rotor seal can define a third pressure chamber inside the bore of the stator housing, and the second longitudinal vane, the second stator and a portion of the second continuous stator seal and a portion of the rotor seal can define a fourth pressure chamber inside the bore of the stator housing. A first passageway through the rotor shaft can fluidly connect the first and third chambers and a second passageway through the rotor shaft can connect the second and fourth chambers. The rotary vane actuator can also include a first port adapted to supply fluid to the first chamber and a second port adapted to supply fluid to the second chamber.

In a second aspect, a method of rotary actuation includes providing a stator housing having a bore disposed axially therethrough, providing a rotor assembly including a central longitudinal shaft and at least a first longitudinal vane disposed radially on a central longitudinal shaft, and at least a second longitudinal vane disposed radially on the central longitudinal shaft, each of said longitudinal vanes connected at a first terminal end to a first circular plate secured to the output shaft and at a second terminal end to a second circular plate secured to the output shaft, each of said vanes having an outer longitudinal edge, said longitudinal edge parallel to a central axis of the longitudinal shaft; said longitudinal edge spaced a distance from the central axis substantially equal to an outer radial distance of a circumferential edge of each of the first and second circular plates wherein a first cylindrical surface of the central longitudinal shaft, a first inner surface of the first plate and a first inner surface of the second plate and a first face of the first longitudinal vane and a first face of the second longitudinal vane define a first interior pocket in the rotor assembly, and wherein a second cylindrical surface of the central longitudinal shaft, a second inner surface of the first plate and a second inner surface of the second plate and a second face of the first longitudinal vane and a second face of the second longitudinal vane define a second interior pocket in the rotor assembly, and a stator assembly including a first stator element adapted to contact the first cylindrical surface in the first pocket and an outer surface adapted to be secured to the bore of the stator housing and sized to be received in the first pocket, said stator element having a first longitudinal edge and a second longitudinal edge, a second stator element having a concave interior surface adapted to contact the second cylindrical surface in the second pocket and an outer surface adapted to be secured to the bore of the stator housing and sized to be received in the second pocket, said stator element having a first longitudinal edge and a second longitudinal edge, at least a first continuous seal groove disposed in the outer longitudinal edge of the first vane and the outer longitudinal edge of the second vane and the circumferential edge of the first plate and the circumferential edge of the second plate and a continuous seal disposed in the continuous seal groove, providing a fluid at a first pressure and contacting the first vane of the rotor assembly with the fluid, providing a fluid at a second pressure less than the first pressure and contacting the second vane of the rotor assembly with the fluid at the second pressure, and rotating the rotor assembly in a first direction of rotation.

Various embodiments can include some, all, or none of the following features. The rotor assembly and the stator assembly can isolate the fluid into a first opposing pair of chambers and a second opposing pair of chambers, and each pair of opposing chambers can be fluidly connected to the other chamber in the pair by a passageway in the rotor, and the method also include providing the fluid at the first pressure to the first opposing pair of chambers, and providing the fluid at the second pressure to the second opposing pair of chambers. The housing and first stator can also include a first fluid port and a second fluid port formed therethrough, and wherein providing the fluid at a first pressure is provided through the first fluid port to the first pair of opposing chambers and providing the fluid at a second pressure is provided through the second fluid port to the second pair of opposing chambers.

The systems and techniques described here may provide one or more of the following advantages. First, a rotary actuator can provide rotational actuation with reduced cross-seal leakage. Second, the rotary actuator can provide improved position-holding ability.

The details of one or more implementations are set forth in the accompanying drawings and the description below. Other features and advantages will be apparent from the description and drawings, and from the claims.

DETAILED DESCRIPTION

Figure 1:
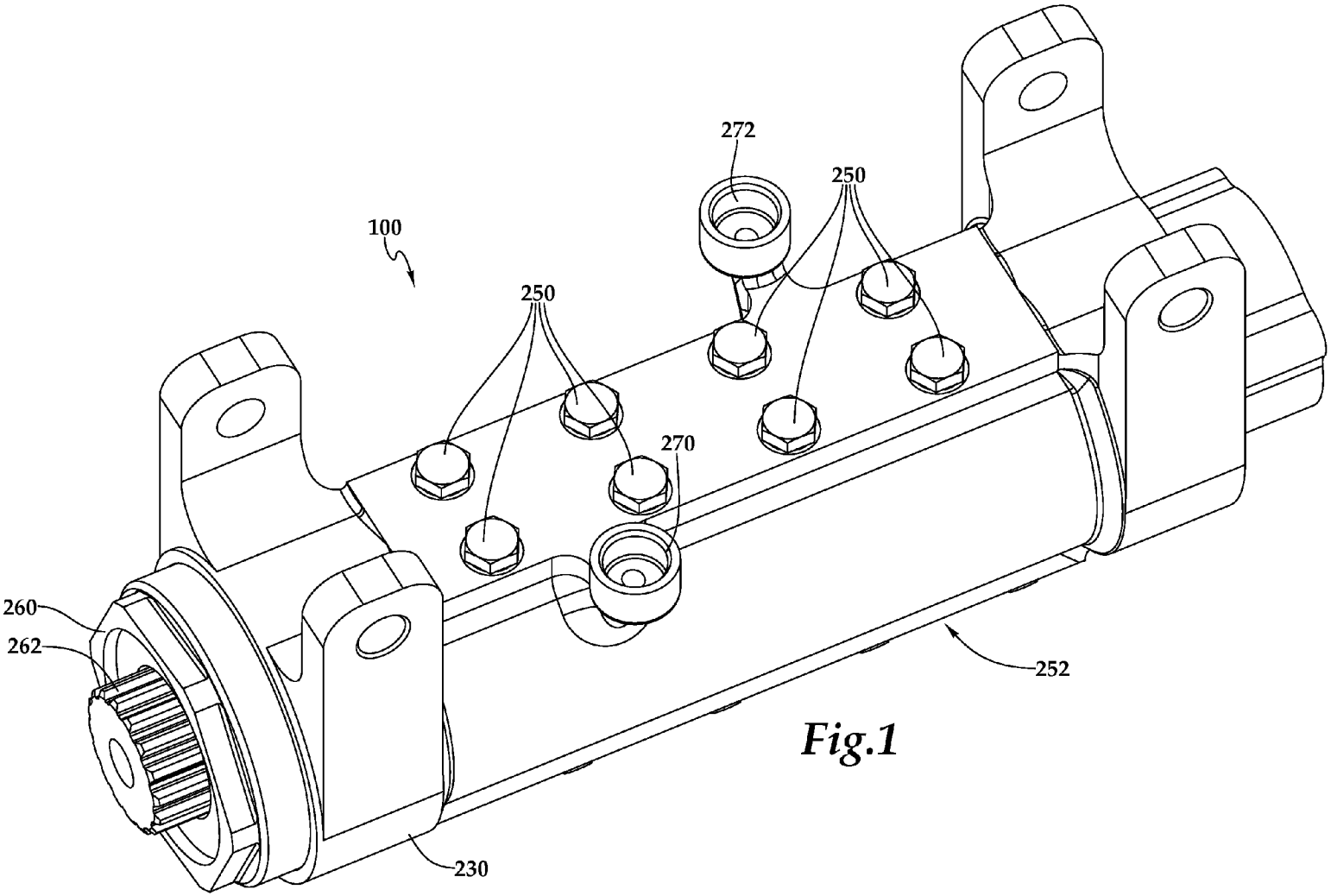
FIG. 1 is a perspective view of an example no corner seal rotary vane actuator.

FIG. 1 is a perspective view of an example no corner seal rotary vane actuator 100. In general, the actuator 100 integrates one or more rotors and rotor vanes with the end plates found in prior rotary vane actuator (RVA) designs to remove the "corner seal" generally present on the rotor shaft to end plate interface. In such configurations, the "rotor seal" seals statically against the rotor end plate and/or rotor vane, and is only in dynamic sealing contact against one seal, e.g., the stator vane seal, as opposed to two separate seals in more conventional RVA configurations. The rotor seal can have at least two different embodiments, a one-piece embodiment will be discussed in the description of FIG. 2A, and two-piece version that will be discussed in the description of FIG. 2B.

The use of such seals inherently reduces the leakage potential of the rotor shaft to end plate sealing interface. In general, by improving this leakage potential, the position holding ability of an RVA, such as the example no corner seal rotary vane actuator 100, can also be improved.

Figure 2A:
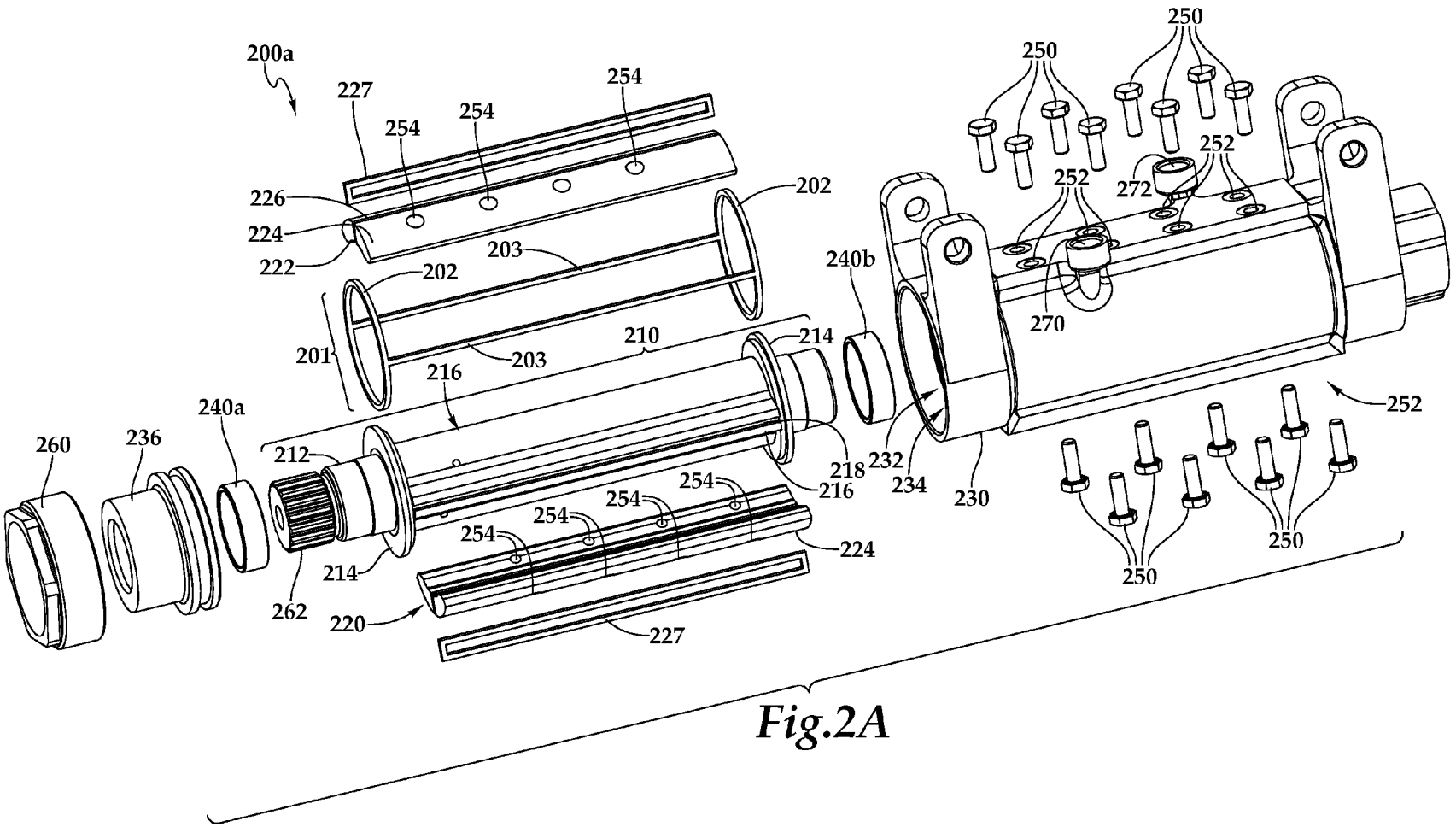
FIG. 2A is an exploded view of an example no corner seal rotary vane actuator with a one-piece rotor seal.

FIG. 2A is an exploded view of an example no corner seal rotary vane actuator 200*a* that includes a one-piece rotor seal 201. In some embodiments, the actuator 200*a* can be the example no corner seal rotary vane actuator 100 of FIG. 1.

The one-piece rotor seal 201 includes two circular end portions 202 that are substantially planar to each other, and two longitudinal axial portions 203 extending between the end portions 202. In some implementations, the one-piece rotor seal 201 can be replaced by a multiple-piece rotor seal, which will be discussed in the description of FIG. 2B.

A rotor 210 includes a central shaft 212, two integral end plates 214 formed near the axial ends of the central shaft 212 and perpendicular to the axis of the central shaft 212. Two integral rotor vanes 216 are formed axially along the central shaft 212 between the end plates 214. The end plates 214 and the rotor vanes 216 include a seal groove 218. The seal groove 218 is formed about an outer periphery of the end plates 214 and axially along an outward peripheral edge of each of the rotor vanes 216. The seal groove 218 is formed to accommodate the rotor seal 201 and bring the rotor seal 201 into sealing contact with an inner surface 232 of a central bore 234 of a housing 230.

The example no corner seal rotary vane actuator 200*a* includes a pair of stator sections 220. Each of the stator sections 220 is a generally semicircular plate having an axial length substantially equal to the lengths of the rotor vanes 216, a thickness substantially equal to the difference between the radius of the central shaft 212 and the radii of the end plates 214, a radially inner surface 222 formed with a curvature substantially equal to that of the central shaft 212, and a radially outward surface 224 formed with a curvature substantially equal to that of the inner surface 232 of the central bore 234.

A seal groove 226 is formed axially along a central portion of the surfaces 222 and 224, and about the ends of each stator section 220. A pair of stator seals 227 are formed to be accommodated within the seal grooves 226. The seal grooves 226 are formed to bring the stator seals 227 into sealing contact with the rotor shaft 212, the end portions 202 of the rotor seal 201, and the inner surface 232 of the central bore 234 when the actuator 200*a* is assembled. In some implementations, each of the stator sections 220 can include two or more of the seal grooves 226 and the stator seals 227 arranged along the length of the stator section 220.

The ends of the rotor shaft 212 are supported by a pair of bearings 240*a*, 240*b*. When assembled, the bearing 240*b* provides support between the rotor shaft 212 and the housing 230. The bearing 240*a* provides support between the rotor shaft 212 and a central bore 235 of a housing end 236.

A collection of fasteners 250, e.g., bolts, are passed through a collection of holes 252 formed through the housing 230. The fasteners 250 are threaded into corresponding threaded holes 254 formed in the stator sections 220 to removably secure the stator sections 220 to the housing 230. An end cap 260 is placed about a bearing housing 236 to at least partially retain the rotor 210, the bearings 240*a*-240*b*, and the bearing housing 236 axially within the central bore 234. A spline section 262 extends radially outward from an end portion of the rotor shaft 212. When assembled the spline section 262 will extend from the central bore 235 of the bearing housing 236 and a central bore 262 of the end cap 260 and thereby be positioned outside of the housing 230. The spline section can be attached to an item to be moved (actuated) by the actuator 200*a*.

A pair of fluid ports 270, 272 are in fluidic communication with fluid chambers defined by an assemblage of the housing 230, the rotor 210, the stator seals 227, and the rotor seal 201. The fluid ports 270, 272 will be discussed further in the descriptions of FIGS. 4 and 6A-6D.

Figure 2B:
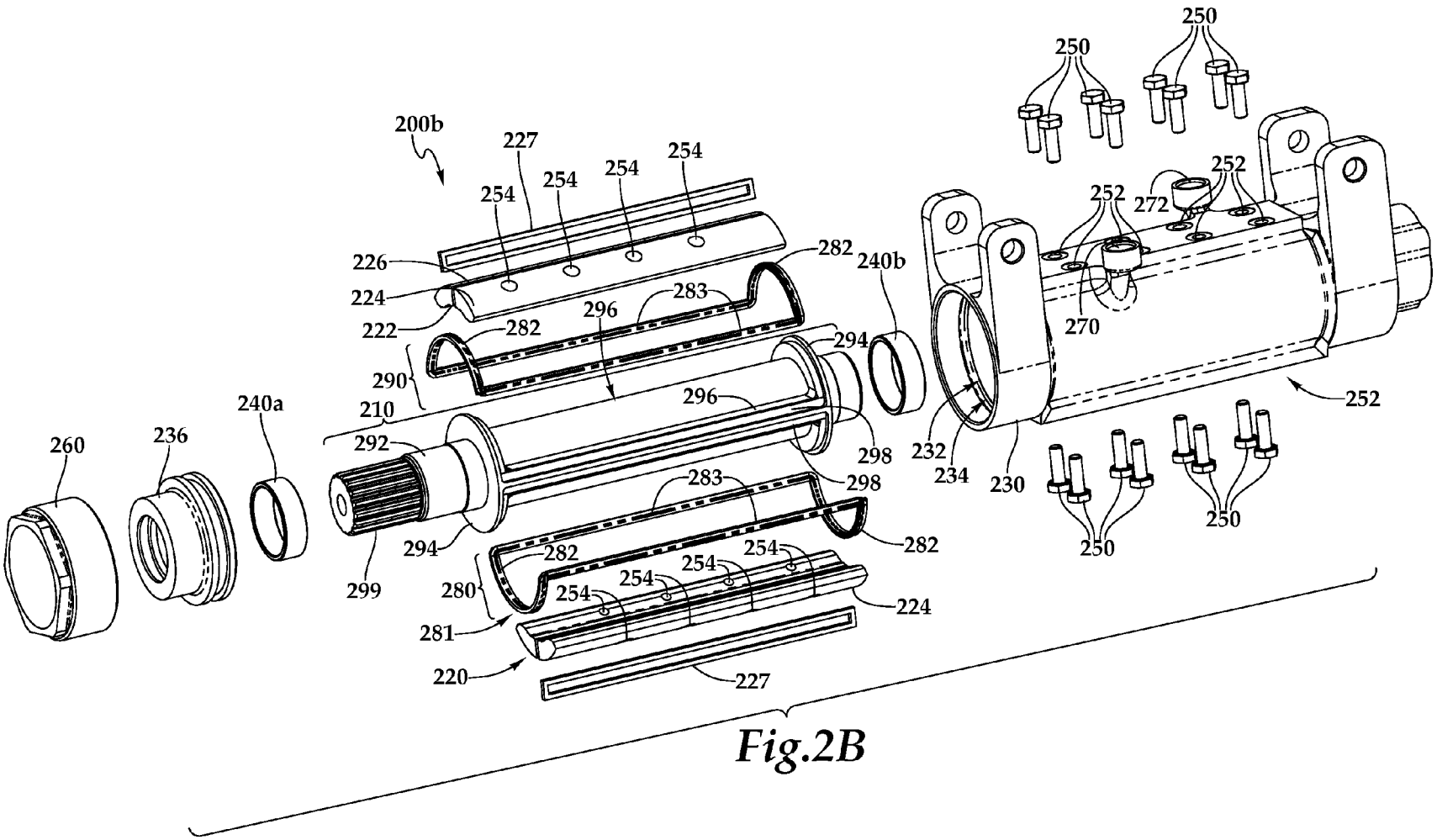
FIG. 2B is an exploded view of an example no corner seal rotary vane actuator with a two-piece rotor seal.

FIG. 2B is an exploded view of an example no corner seal rotary vane actuator 200*b* with a two-piece rotor seal assembly 280. In some embodiments, the example no corner seal rotary vane actuator 200*b* can be the example no corner seal rotary vane actuator 100 of FIG. 1. In general, the example no corner seal rotary vane actuator 200*b* is substantially similar to the example no corner seal rotary vane actuator 200*a* of FIG. 2A, with the one-piece rotor seal 201 replaced by the two-piece rotor seal assembly 280, and the rotor 210 replaced by a rotor 290.

The two-piece rotor seal assembly 280 includes two rotor seals 281. Each of the rotor seals 281 includes two semicircular end portions 282 that are substantially planar to each other, and two axial portions 283 extending between the end portions 282. In some implementations, the two-piece rotor seal assembly 280 can include more than two of the rotor seals 281.

The rotor 290 includes a central shaft 292, two integral end plates 294 formed near the axial ends of the central shaft 292 and perpendicular to the axis of the central shaft 292. Two integral rotor vanes 296 are formed axially along the central shaft 292 between the end plates 294. The end plates 294 and the rotor vanes 296 include two seal grooves 298. Each of the seal grooves 298 is formed about a semicircular section of an outer periphery of the end plates 294 and axially along an outward peripheral edge of each of the rotor vanes 296. Each seal groove 298 is formed to accommodate one of the rotor seals 280 and bring the rotor seals 280 into sealing contact with the inner surface 232 of the central bore 234 of the housing 230.

The example no corner seal rotary vane actuator 200*b* includes the pair of stator sections 220 that include the seal grooves 226 and the stator seals 227. The stator section 220 brings the stator seals 227 into sealing contact with the rotor shaft 292, the end portions 282 of the rotor seals 281, and the inner surface 232 of the central bore 234 when the example no corner seal rotary vane actuator 200*b* is assembled. In some implementations, each of the stator sections 220 can include two or more of the seal grooves 226 and the stator seals 227 arranged along the length of the stator section 220.

The ends of the rotor shaft 292 are supported by the bearings 240*a*, 240*b*. When assembled, the bearing 240*b* provides support between the rotor shaft 292 and the housing 230. The bearing 240*a* provides support between the rotor shaft 292 and the central bore 235 of the housing end 236.

The collection of fasteners 250, e.g., bolts, are passed through the holes 252 formed through the housing 230. The fasteners 250 are threaded into corresponding threaded holes 254 formed in the stator sections 220 to removably secure the stator sections 220 to the housing 230. The end cap 260 is placed about the bearing housing 236 to at least partially retain the rotor 290, the bearings 240*a*-240*b*, and the bearing housing 236 axially within the central bore 234. A spline section 299 extends radially outward from the end portions of the rotor shaft 292. When assembled, the spline section 299 will extend from the central bore 235 of the bearing housing 235 and the central bore 262 of the end cap 260 and thereby be positioned outside of the housing 230. The spline section 299 can be attached to an item to be moved (actuated) by the actuator 200*b*

The pair of fluid ports 270, 272 are in fluidic communication with fluid chambers defined by an assemblage of the housing 230, the rotor 290, the stator seals 227, and the rotor seal assembly 280. The fluid ports 270, 272 will be discussed further in the descriptions of FIGS. 4 and 5A-5D.

Figure 3:
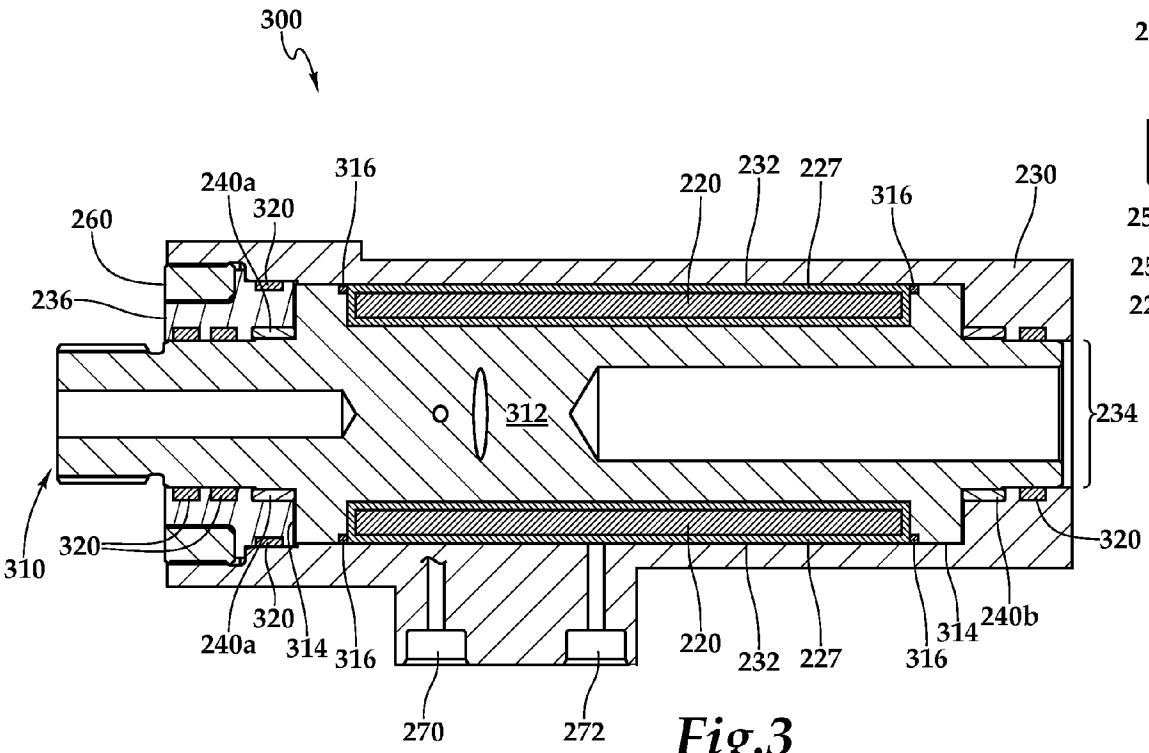
FIG. 3 is a cross-sectional side view of an example no corner seal rotary vane actuator.

FIG. 3 is a cross-sectional side view of an example no corner seal rotary vane actuator 300. In some embodiments, the actuator 300 can be the example no corner seal rotary vane actuator 200*a* of FIG. 2A or the example no corner seal rotary vane actuator 200*b* of FIG. 2B in their assembled forms.

The example no corner seal rotary vane actuator 300 includes a rotor 310, which is positioned within the central bore 234 of the housing 230. In some embodiments, the rotor 310 can be the rotor 212 or the rotor 290. The rotor 310 is rotatably supported at one axial end by the bearing 240*b* and the housing 230. The rotor 310 is rotatably supported at the other axial end by the bearing 240*a* and the bearing housing 236. The bearing housing 236 is removably secured in place by the end cap 260.

The stator sections 220 are positioned to hold the stator seals 227 in substantially sealing contact with the inner surface 232, and a rotor shaft 312, a pair of integral end plates 414, and a rotor seal 316 of the rotor 310. In some embodiments, e.g., the example no corner seal rotary vane actuator 200*a*, the rotor seal 316 can be the one-piece rotor seal 201 of FIG. 2A. In some embodiments, e.g., the example no corner seal rotary vane actuator 200*b*, the rotor seal 316 can be the two-piece rotor seal assembly 280 of FIG. 2B.

The pair of fluid ports 270, 272 are in fluidic communication with fluid chambers formed by the housing 230, the rotor 310, the stator seals 227, and the rotor seal 316. The fluid ports 270, 272 will be discussed further in the descriptions of FIGS. 4, and 5A-5D. A collection of axial seals 320 substantially prevent the intrusion of dust, water, and/or other external contaminants into the interior of the example no corner seal rotary vane actuator 300.

Figure 4:
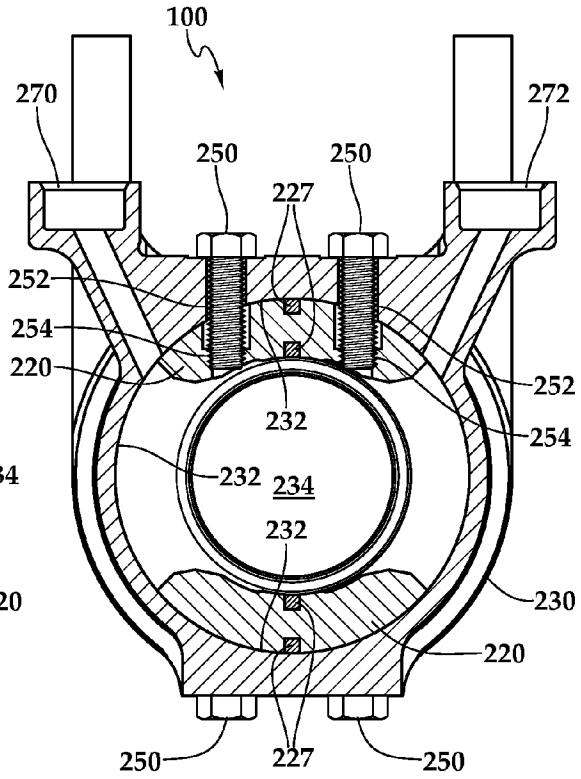
FIG. 4 is a cross-sectional end view of an example no corner seal rotary vane actuator with a one-piece rotor seal.

FIG. 4 is a cross-sectional end view of the example no corner seal rotary vane actuator 100 which includes the one-piece rotor seal 201. During assembly, the stator sections 220 are inserted into bore 234 of the housing 230 and the fasteners 250 are inserted through the holes 252 and are threaded into the threaded holes 254 to removably secure the stator sections 220 to the housing 230. The stator sections 220 maintain the stator seals 227 in sealing contact with the inner surface 232 and the rotor shaft 212 (not shown in this view). In some embodiments, the stator sections 220 may be fastened to the housing in arrangements other that the one illustrated in the example FIG. 4, which depicts two rows of fasteners arranged axially on each side of the stator seals 227. For example, one or both of the stator sections 220 may be formed with two or more of the stator seal grooves 226, and the fasteners 250, the holes 252, and the threaded holes 254 may be arranged between pairs of the seal grooves 226 formed in a single one of stator sections 220.

FIGS. 5A-5D are cross-sectional end views of the example no corner seal rotary vane actuator 200*a* in four example rotational configurations 500*a*-500*d*. Although the example rotational configurations 500*a*-500*d* are illustrated and described as implementing the example no corner seal rotary vane actuator 200*a* of FIG. 2A, in some embodiments the example rotational configurations 500*a*-500*d* can implement the example no corner seal rotary vane actuator 200*b* of FIG. 2B.

The cross-sectional views of FIGS. 5A-5D show the example no corner seal rotary vane actuator 200*a* with the rotor 210. The rotor 210, the stator sections 220, and the housing 230 form a pair of pressure chambers 510*a*, 510*b* and a pair of pressure chambers 512*a*, 512*b*. The pressure chambers 510*a*, 510*b* are located substantially opposite each other on opposing radial sides of the rotor 210, and are in fluidic communication through a fluid channel 514. A fluid, e.g., hydraulic fluid, air or gas, is applied at the fluid port 270 and flows into the pressure chamber 510*a*, through the fluid channel 514, and into the pressure chamber 510*b* thereby substantially balancing the pressures in the pressure chambers 510*a* and 510*b*. The fluid may escape the pressure chamber 510*b* through the fluid channel 514 into the pressure chamber 510*a* and out the fluid port 270. The pressure chambers 512*a*, 512*b* are located substantially opposite each other on opposing radial sides of the rotor 210 opposite the pressure chambers 510*a*, 510*b*, and are in fluidically communication through a fluid channel 516. A fluid, e.g., hydraulic fluid, air, applied at the fluid port 272 can flow into the pressure chamber 512*a*, through the fluid channel 516, and into the pressure chamber 512*b* thereby substantially balancing the pressures in the pressure chambers 512*a* and 512*b*. The fluid may escape the pressure chamber 512*b* through the fluid channel 516 into the pressure chamber 512*a* and out the fluid port 272.

Figure 5A:
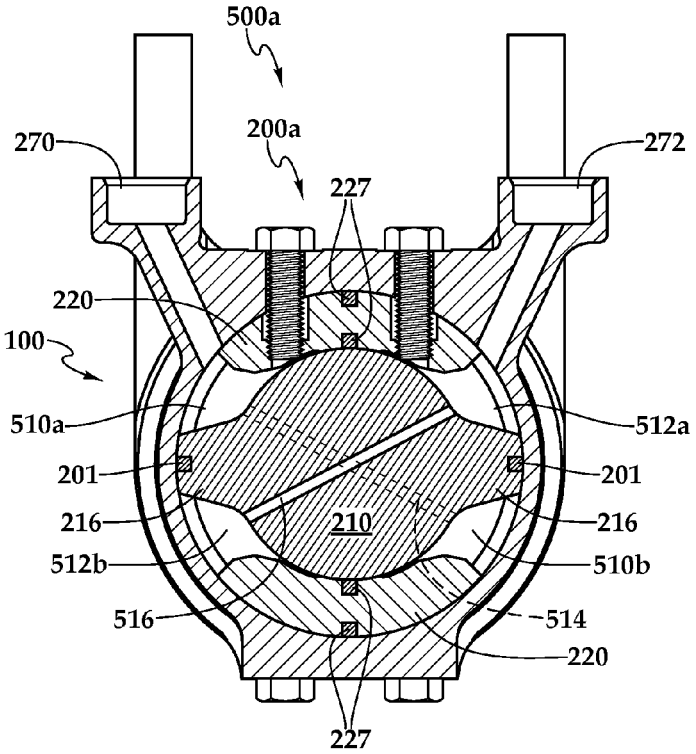
FIGS. 5A-5D are cross-sectional end views of an example no corner seal rotary vane actuator in example rotational configurations.

FIG. 5A depicts the example no corner seal rotary vane actuator 200*a* of FIG. 2A with the pressure chambers 512*a*, 512*b* pressurized at a mid-stroke rotational configuration of the rotor 210. When fluid is applied to the fluid port 272, the pressure chambers 512*a*, 512*b* become pressurized and urge rotation of the rotor 210 in a clockwise rotational direction. In some implementations, the rotor 210 can be held a substantially fixed rotational position by holding the pressures of the fluid ports 270 and/or 272 steady, e.g., by fluidically blocking one or both of the fluid ports 270, 272. The configuration of the rotor seals 201 and the stator seals 227 substantially eliminates the use of corner seals used in prior designs and reduces the potential for cross-chamber fluid leakage that occurs across the corner seals of prior designs, and thereby improves the ability of the example no corner seal rotary vane actuator 200*a* to maintain a rotational position when the fluid ports 270, 272 are held at a steady pressure, e.g., are fluidically blocked.

Figure 5B:
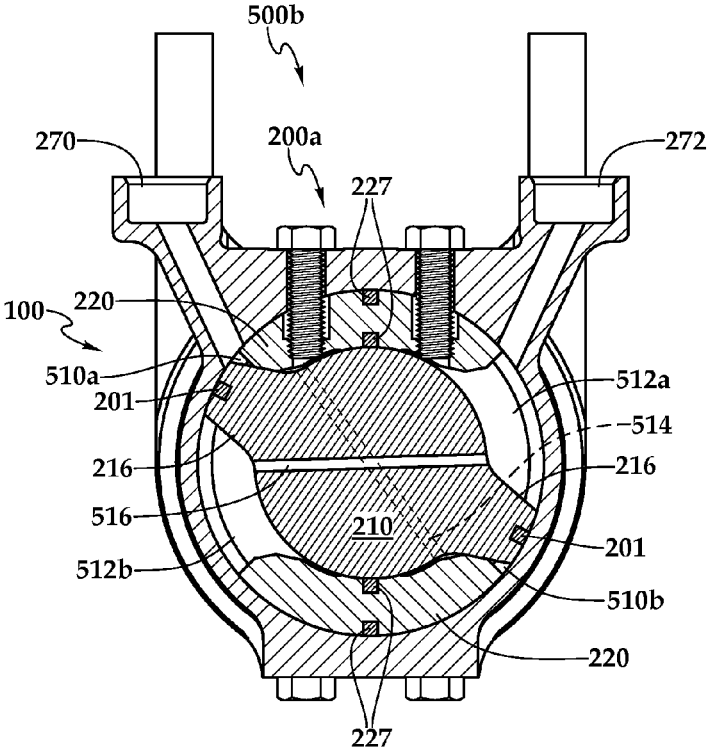

FIG. 5B depicts the example no corner seal rotary vane actuator 200*a* of FIG. 2A with the pressure chambers 512*a*, 512*b* pressurized at a clockwise hard-stopped rotational configuration of the rotor 210. When fluid is applied to the fluid port 272, the pressure chambers 512*a*, 512*b* become pressurized and urge rotation of the rotor 210 in a clockwise rotational direction. In the illustrated example, the clockwise rotation of the rotor 210 can stop when the clockwise faces of one or both rotor vanes 216 contacts one or both of the counterclockwise end faces of the stator sections 220.

Figure 5C:
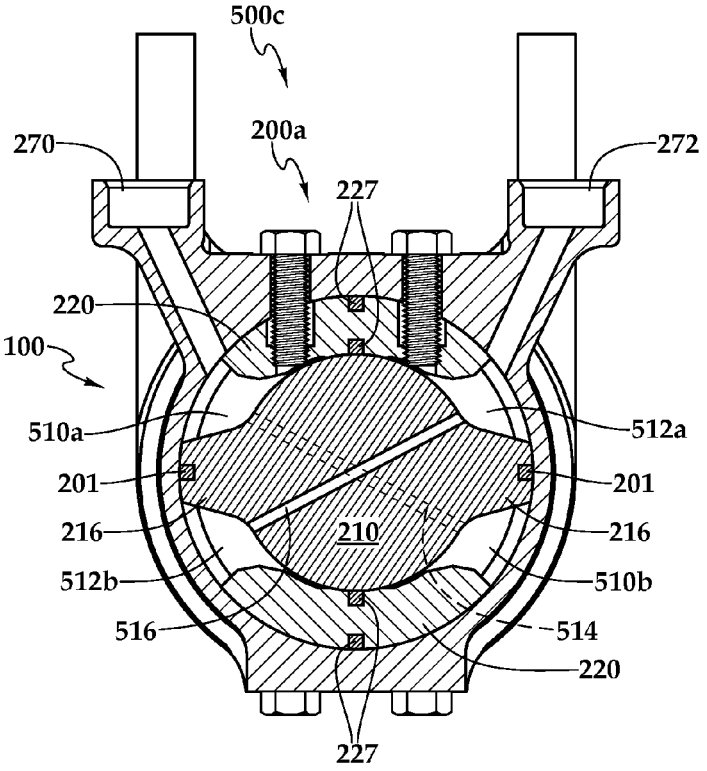

FIG. 5C depicts the example no corner seal rotary vane actuator 200*a* of FIG. 2A with the pressure chambers 512*a*, 512*b* pressurized at another mid-stroke rotational configuration of the rotor 210. For example, the configuration depicted by FIG. 5C may be achieved when the rotor 210 is rotated away from the rotation configuration shown in FIG. 5B. When fluid is applied to the fluid port 270, the pressure chambers 510*a*, 510*b* become pressurized and urge rotation of the rotor 210 in a counterclockwise rotational direction. In some implementations, the rotor 210 can be held a substantially fixed rotational position by holding the pressures of the fluid ports 270 and/or 272 steady, e.g., by fluidically blocking one or both of the fluid ports 270, 272.

Figure 5D:
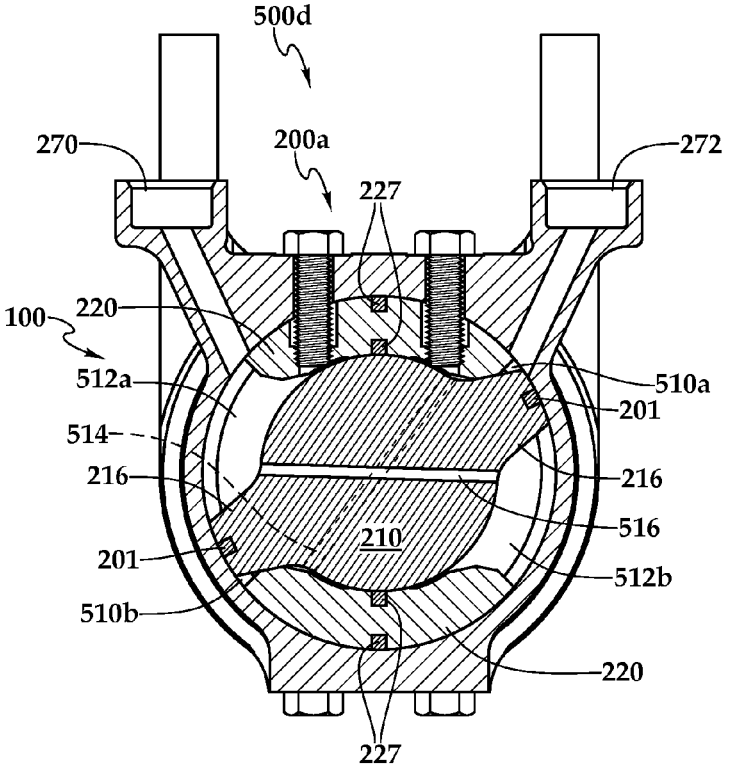

FIG. 5D depicts the example no corner seal rotary vane actuator 200*a* of FIG. 2A with the pressure chambers 510*a*, 510*b* pressurized at a counterclockwise hard-stopped rotational configuration of the rotor 210. When fluid is applied to the fluid port 270, the pressure chambers 510*a*, 510*b* become pressurized and urge rotation of the rotor 210 in a counterclockwise rotational direction. In the illustrated example, the counterclockwise rotation of the rotor 210 can stop when the counterclockwise faces of one or both rotor vanes 216 contacts one or both of the clockwise end faces of the stator sections 220.

Although a few implementations have been described in detail above, other modifications are possible. For example, various combinations of single piece rotor seals, multiple piece rotor seals, single piece stator seals, and multiple piece stator seals may be combined to achieve desirable results. In addition, other components may be added to, or removed from, the described actuators. Accordingly, other embodiments are within the scope of the following claims.

What is claimed is:

1. A method of assembly of a rotary actuator comprising:

providing a unitary stator housing having a longitudinal bore disposed axially therethrough;

providing a rotor assembly including:

a central longitudinal shaft, and at least a first longitudinal vane formed integrally with and disposed radially on a central longitudinal shaft, and at least a second longitudinal vane formed integrally with and disposed radially on the central longitudinal shaft, each of said longitudinal vanes connected at a first terminal end to a first circular plate formed integrally with the central shaft and at a second terminal end to a second circular plate formed integrally with the central shaft, each of said vanes having an outer longitudinal edge, said longitudinal edge parallel to a central axis of the longitudinal shaft, said longitudinal edge spaced a distance from the central axis substantially equal to an outer radial distance of a circumferential edge of each of the first and second circular plates;

a first continuous seal groove disposed in the outer longitudinal edge of the first vane and the outer longitudinal edge of the second vane and the circumferential edge of the first plate and the circumferential edge of the second plate;

a continuous rotor seal disposed in the first continuous seal groove;

wherein a first cylindrical surface of the central longitudinal shaft, a first inner surface of the first plate and a first inner surface of the second plate and a first face of the first longitudinal vane and a first face of the second longitudinal vane define a first interior pocket in the rotor assembly, and wherein a second cylindrical surface of the central longitudinal shaft, a second inner surface of the first plate and a second inner surface of the second plate and a second face of the first longitudinal vane and a second face of the second longitudinal vane define a second interior pocket in the rotor assembly;

providing a stator assembly and assembling the stator assembly to the rotor assembly to form a combination assembly, said assembling the stator assembly to the rotor assembly comprising:

contacting with a concave interior surface of a first stator element the first cylindrical surface in the first pocket of the rotor assembly outside of the unitary stator housing;

contacting with a concave interior surface of a second stator element the second cylindrical surface in the second pocket outside of the unitary stator housing;

after assembling the stator assembly to the rotor assembly outside of the unitary stator housing, inserting the combination assembly longitudinally into the longitudinal bore of the unitary stator housing;

securing an outer convex surface of the first stator element to a concave inner surface of the longitudinal bore of the unitary stator housing subsequent to inserting the combination assembly into the longitudinal bore; and securing an outer convex surface of the second stator element to a concave inner surface of the longitudinal bore of the housing subsequent to inserting the combination assembly into the longitudinal bore.

2. The method of claim 1 further including, after securing the outer convex surface of the first stator element to the longitudinal bore and after securing the outer convex surface of the second stator element to the longitudinal bore:

contacting a first longitudinal edge of the first stator element with the first face of the first longitudinal vane when the rotor assembly is rotated in the first direction;

contacting a first longitudinal edge of the second stator element with the first face of the second longitudinal vane when the rotor assembly is rotated in the first direction;

contacting a second longitudinal edge of the first stator element with the second face of the second longitudinal vane when the rotor assembly is rotated in a second direction opposite to the first direction; and contacting a second longitudinal edge of the second stator element with the second face of the first longitudinal vane when the rotor assembly is rotated in the second direction.

3. The method of claim 1, wherein:

the first stator element has a first longitudinal edge and a second longitudinal edge with a continuous seal groove disposed in the concave inner surface of the first stator element, and a convex outer surface of the first stator element, a first transverse end and a second transverse end of the first stator element and a first continuous stator seal disposed in the continuous seal groove; and the second stator element having a first longitudinal edge and a second longitudinal edge with a continuous seal groove disposed in the concave inner surface of the second stator element, and a convex outer surface of the second stator element and a first and second transverse end of the second stator element and a second continuous stator seal disposed in the continuous seal groove.

4. A method of assembly of a rotary actuator comprising:

providing a unitary stator housing having a longitudinal bore disposed axially therethrough;

providing a rotor assembly including:

a central longitudinal shaft, and at least a first longitudinal vane formed integrally with and disposed radially on a central longitudinal shaft, and at least a second longitudinal vane formed integrally with and disposed radially on the central longitudinal shaft, each of said longitudinal vanes connected at a first terminal end to a first circular plate formed integrally with the central shaft and at a second terminal end to a second circular plate formed integrally with the central shaft, each of said vanes having an outer longitudinal edge, said longitudinal edge parallel to a central axis of the longitudinal shaft; said longitudinal edge spaced a distance from the central axis substantially equal to an outer radial distance of a circumferential edge of each of the first and second circular plates;

a first continuous seal groove disposed in the outer longitudinal edge of the first vane and the outer longitudinal edge of the second vane and the circumferential edge of the first plate and the circumferential edge of the second plate;

a first continuous rotor seal groove disposed in a first portion of the outer longitudinal edge of the first vane and a first portion of the outer longitudinal edge of the second vane and a first portion of the circumferential edge of the first plate and a first portion of the circumferential edge of the second plate;

a second continuous rotor seal groove disposed in a second portion of the outer longitudinal edge of the first vane and in a second portion of the outer longitudinal edge of the second vane and a second portion of the circumferential edge of the first plate and a second portion of the circumferential edge of the second plate;

a first continuous rotor seal disposed in the first continuous seal groove; and a second continuous rotor seal disposed in the second continuous seal groove;

wherein a first cylindrical surface of the central longitudinal shaft, a first inner surface of the first plate and a first inner surface of the second plate and a first face of the first longitudinal vane and a first face of the second longitudinal vane define a first interior pocket in the rotor assembly, and wherein a second cylindrical surface of the central longitudinal shaft, a second inner surface of the first plate and a second inner surface of the second plate and a second face of the first longitudinal vane and a second face of the second longitudinal vane define a second interior pocket in the rotor assembly;

providing a stator assembly and assembling the stator assembly to the rotor assembly to form a combination assembly, said assembling the stator assembly to the rotor assembly comprising:

contacting with a concave interior surface of a first stator element the first cylindrical surface in the first pocket of the rotor assembly outside of the unitary stator housing;

contacting with a concave interior surface of a second stator element the second cylindrical surface in the second pocket outside of the unitary stator housing;

after assembling the stator assembly to the rotor assembly outside of the unitary stator housing, inserting the combination assembly longitudinally into the longitudinal bore of the unitary stator housing;

securing an outer convex surface of the first stator element to the longitudinal bore of the unitary stator housing subsequent to inserting the combination assembly; and securing an outer convex surface of the second stator element to the longitudinal bore of the unitary stator housing subsequent to inserting the combination assembly.

5. The method of claim 4 further including, after securing the outer convex surface of the first stator element to the bore and after securing the outer convex surface of the second stator element to the longitudinal bore:

contacting a first longitudinal edge of the first stator element with the first face of the first longitudinal vane when the rotor assembly is rotated in the first direction;

contacting a first longitudinal edge of the second stator element with the first face of the second longitudinal vane when the rotor assembly is rotated in the first direction;

contacting a second longitudinal edge of the first stator element with the second face of the second longitudinal vane when the rotor assembly is rotated in a second direction opposite to the first direction; and contacting a second longitudinal edge of the second stator element with the second face of the first longitudinal vane when the rotor assembly is rotated in the second direction.

* * * * *